United States Patent [19]

Sparks et al.

[11] 4,235,472

[45] Nov. 25, 1980

[54] SLEEPING DEVICE FOR SITTING POSITION

[76] Inventors: Robert Sparks, c/o George Spector, 3615 Woolworth Bldg., 233 Broadway; George Spector, 3615 Woolworth Bldg., 233 Broadway, both of New York, N.Y. 10007

[21] Appl. No.: 918,148

[22] Filed: Jun. 22, 1978

[51] Int. Cl.[3] ..... A47C 4/52

[52] U.S. Cl. ..... 297/392; 297/193

[58] Field of Search ..... 297/183, 462, 192, 193, 297/392; 108/43; 248/444

[56] References Cited

U.S. PATENT DOCUMENTS

| | | | |
|---|---|---|---|
| 1,134,720 | 4/1915 | Bradley | 5/431 X |
| 2,528,768 | 11/1950 | Marsh | 297/462 X |
| 2,564,924 | 8/1951 | Patton | 297/183 |
| 2,566,818 | 9/1951 | Babit | 297/462 X |
| 2,592,912 | 4/1952 | Knipper | 297/192 X |
| 2,688,142 | 9/1954 | Jensen | 5/338 |
| 2,698,870 | 12/1954 | Mende | 297/193 X |
| 2,782,427 | 2/1957 | Ericson | 5/338 |
| 3,315,282 | 4/1967 | Lowery et al. | 297/392 X |
| 3,633,969 | 1/1972 | Wininger | 297/462 |
| 3,828,377 | 8/1974 | Fary, Sr. | 297/392 X |
| 3,828,377 | 8/1974 | Fary, Sr. | 5/338 |
| 4,052,944 | 10/1977 | Jennings | 108/43 |

FOREIGN PATENT DOCUMENTS

| | | | |
|---|---|---|---|
| 89709 | 7/1937 | Sweden | 108/43 |

*Primary Examiner*—James T. McCall

[57] ABSTRACT

A set of block-like pillow components which can be assembled in various ways so to accomodate different body resting positions while sitting up, instead of laying down, the components also including one so to serve as a food tray, and in a modified design of the invention, the assembled units form a container for carrying food, the components being molded of plastic styrofoam.

1 Claim, 2 Drawing Figures

Fig. 8
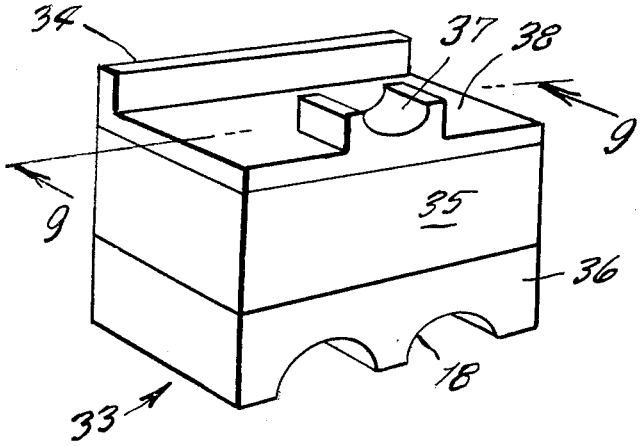
Fig. 9
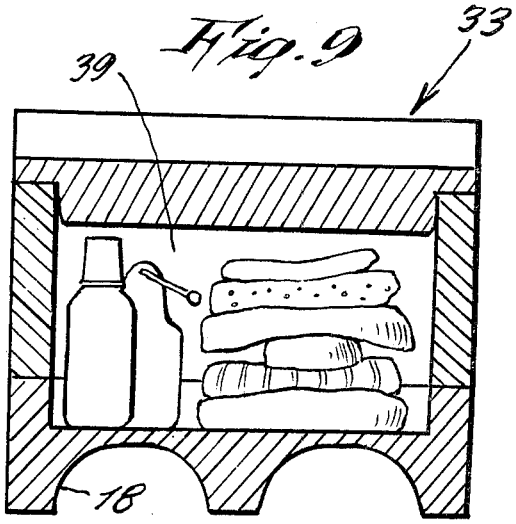
Fig. 10
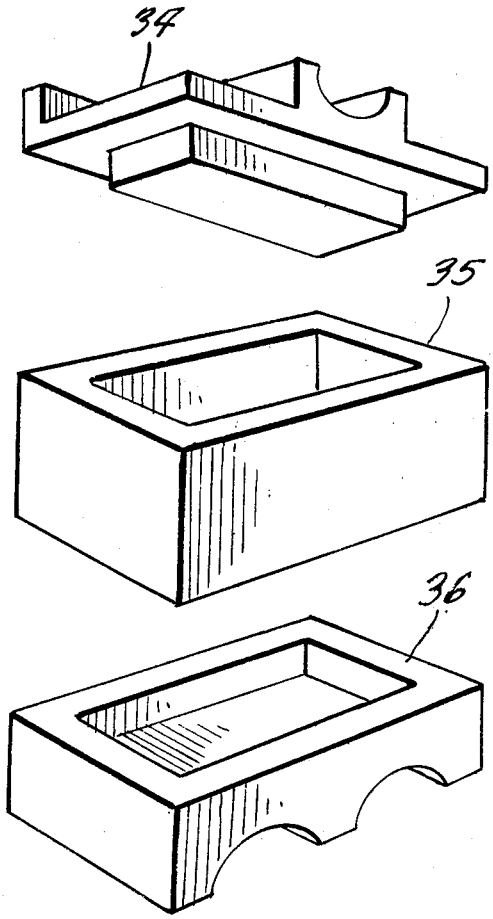
Fig. 11
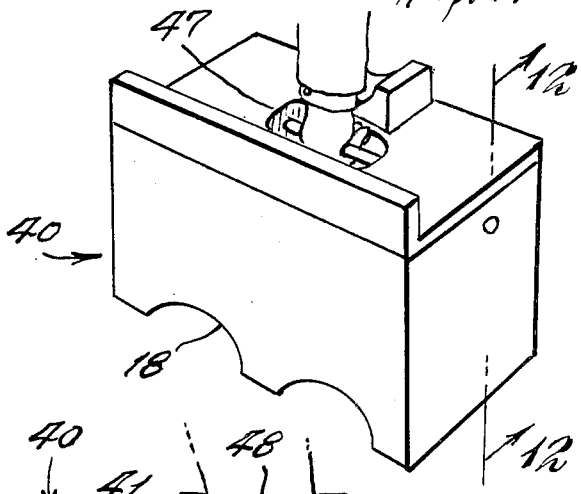
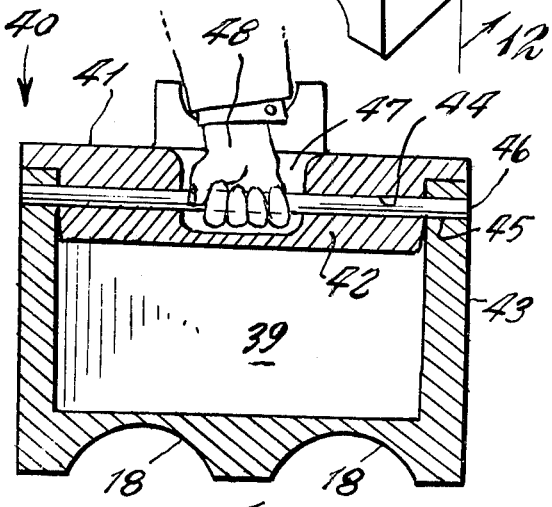
Fig. 12

SLEEPING DEVICE FOR SITTING POSITION

This invention relates generally to sleeping and resting items.

A principal object of the present invention is to provide a sleeping device upon which a person can rest while in a sitting up position.

Another object is to provide a sleeping device which is made up of several components that can be variably assembled together in order to accomodate different resting positions of a person while sitting up.

Still another object is to provide a sleeping device which additionally includes a component for serving as a food tray, and also another component for comfortably and securely supporting the food tray across a persons lap while sitting up.

Yet another object is to provide a sleeping device which in one design allows the components to be assembled together in a manner so to form a convenient carrying case.

Yet a further object is to provide a sleeping device which will be ideal for persons to rest while seated in an automobile, such as truck drivers resting on long trips, or which can be used by numerous other persons, such as to eat a snack while watching TV, as well as for others in numerous other situations, such as at picnics out-of-doors or at a beach, construction workers at a lunch break on a job, or the like.

Figure 7:
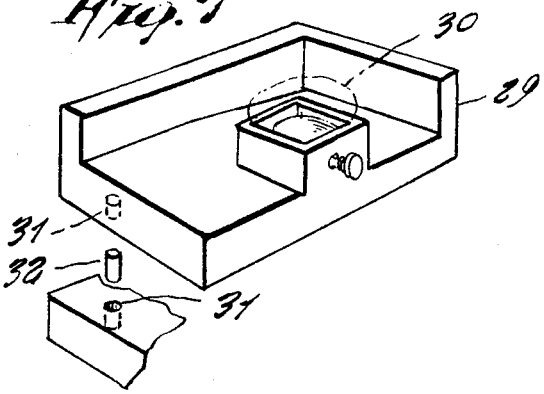

FIG. 7 shows a modified design of one of the components in which the chin block rest is hollowed out and an inflatable rubber balloon contained therein so to be adjustable in height and softness for a person resting either her chin or a side of a face thereupon, the figure also showing the components being selectively securable together by means of removable pegs so to prevent a pile of the components slipping apart while a person rests thereupon.

FIG. 8 is a perspective view of a modified design of the invention with all the components stacked together.

FIG. 9 is a cross sectional view taken on line 9—9 of FIG. 8, and showing the device used as a suit case storing clothing and other items.

FIG. 10 is a view showing all the components separated from each other.

FIG. 11 is a view similar to FIG. 8 and showing another modified design thereof in which the lower two parts are now made in one piece, and the top is securable thereto by a stick that serves as a handle so to carry the assembled device like a suit case.

FIG. 12 is a cross sectional view on line 12—12 of FIG. 11.

Figure 1:
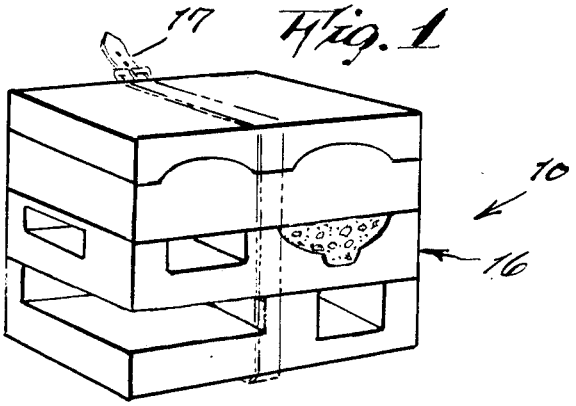
FIG. 1 is a perspective view of the invention shown with components assembled all together so to be compact for convenient storage or transporting.

Referring now to the drawings in greater detail, and more particularly to FIGS. 1 through 6 at this time, the reference numeral 10 represents a sleeping device according to the present invention wherein the same is comprised of a double grooved member 11, a double tray member 12, an L-shaped channelled member 13, a U-shaped channelled member 14 and sponge member 15 which can be fitted one upon another so to form the compact assembly 16 shown in FIG. 1 in order that it can be tied together with a strap 17 for convenient carriage or storage. All the members, except the sponge are made of a stiff styrofoam whereas the sponge may be of resilient rubber or pliable sponge plastic.

Figure 4:
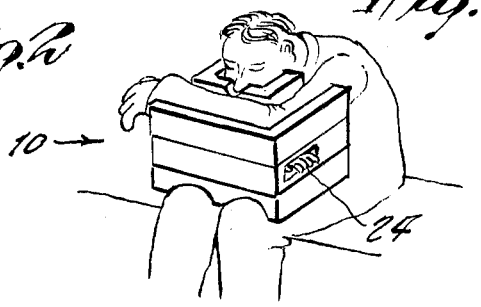
Figure 6:
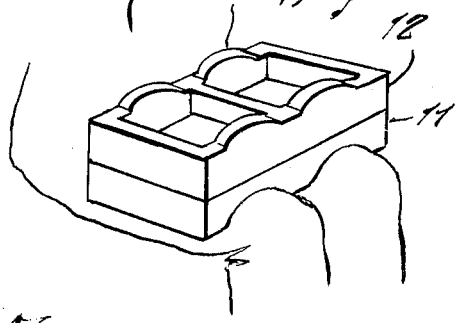

The member 11 includes rounded grooves 18 so to fit a persons legs when placed in a lap, as shown in FIG. 4. The grooves also fit upwardly rounded projections 19 of member 12. Depressions 20 upon member 12 serve to receive objects, and as shown in FIG. 6, when member 12 is placed upon member 11 supported in a lap, the depressions can hold lunch food while eating therefrom, or used to hold a knitting while a sitting person knits, or the like.

Member 13 includes a L-shaped channel 21 for receiving an arm 22 of a person as shown in FIG. 4.

Member 14 includes a U-shaped channel 22 around a center post 23 so to receive the other arm of a person, as is evident by the figures 24 shown in the same figure.

A rounded depression 25 on members 13 serves to receive the sponge 15 so a persons chin can rest comfortably thereupon, as shown in FIG. 4. Otherwise, the chin can rest directly on the surface of the depression without use of the sponge.

The device can be used in numerous other ways for resting upon while a person sleeps or just reposes, while sitting, as suggested in FIGS. 3 to 6.

Figure 3:
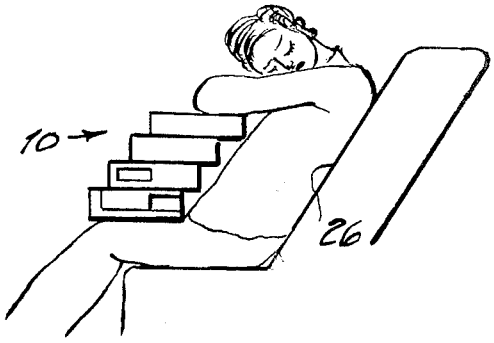
FIG. 3, 4, 5 and 6 illustrate various of the components in use as a rest for a person, FIG. 3 showing a person in reclined position, FIG. 4 showing one arm and a chin rested, FIG. 5 showing a top view with both arms and a chin rested on a block, FIG. 6 showing a compartmented tray component resting on a leg rest component.
Figure 2:
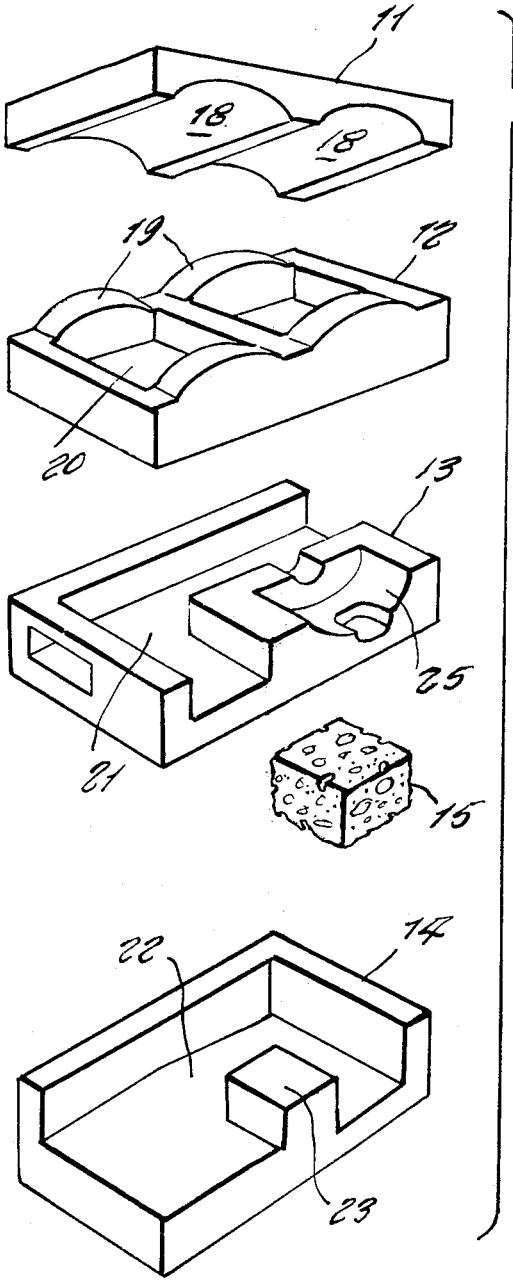
FIG. 2 shows the components thereof separated.
Figure 5:
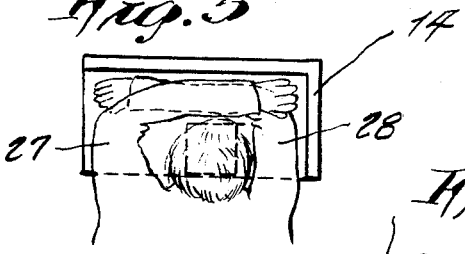

The members can be stacked contilevered, as shown in FIG. 3 so to accomodate a person having her back resting against inclined backrest 26 of a chair. A person can rest her chin upon the block 23 and fit both arms 27 and 28 in the U-shaped channel 22, as shown in FIG. 5. These are only a few examples of use. Numerous others would be readily apparent.

In FIG. 7, a member 29 is a same as member 14 except that the block 23 is hollowed, and an inflatable rubber balloon 30 placed therein is accordingly selectively adjustable for size and softness for a persons chin placed thereupon.

An assortment of holes 31 on all the members may be provided so that pegs 32 can selectively be fitted therein so to retain any shape of assembly from falling apart when in use.

A modified design of the invention 33 shown in FIGS. 8 to 10 includes a top member 34, tubular member 35 and tray member 36. The member 34 includes a chin rest block 37 and U-shaped channel 38 therearound. The tray member includes the lap grooves 18 described above.

When the device is assembled as shown in FIG. 9, a central compartment 39 is thus formed so to hold food or other objects.

Another design of device 40 shown in FIGS. 11 and 12 includes a member 41 that is similar to member 34 except that it includes a downward portion 42 that extends downward inside an open box-like member 43. A horizontal hole 44 through the member 41 aligns with holes 45 in the member 43 so a wood stick 46 can be fitted therethrough so to hold the members together. A downward recess 47 in member 41 allows a persons hand 48 to grasp the stick so to conveniently form a handle in order to carry the assembled device. The member 41 thus serves as a removable lid for the member 43.

What is claimed is:

1. A portable device adapted to be used for sleeping in a sitting position comprising a lower lap engaging surface which contacts the persons lap to support the device, including a chin rest to support a chin, an appropriate distance above the lap when sitting, including arm rest channels formed in the device adapted to receive and support a persons arms above the lap wherein said channels are at different levels, one of said channels formed through the interior of said device below the chin rest and the other of said channels adjacent said chin rest at the same level above the lap.

* * * * *